US011512839B1

(12) United States Patent
Delalande et al.

(10) Patent No.: US 11,512,839 B1
(45) Date of Patent: Nov. 29, 2022

(54) LED LIGHTBULB WITH ADJUSTABLE COLOR TEMPERATURE

(71) Applicant: Green Creative, LTD, Hong Kong (CN)

(72) Inventors: Bertrand Delalande, Shanghai (CN); Zheng Juntao, Shanghai (CN)

(73) Assignee: Green Creative Ltd., Hong Kong (CN)

( * ) Notice: Subject to any disclaimer, the term of this patent is extended or adjusted under 35 U.S.C. 154(b) by 0 days.

(21) Appl. No.: 17/803,372

(22) Filed: Jun. 1, 2022

(51) Int. Cl.

| | |
|---|---|
| ***F21V 19/00*** | (2006.01) |
| ***F21V 7/00*** | (2006.01) |
| ***F21V 29/70*** | (2015.01) |
| ***F21Y 115/10*** | (2016.01) |

(52) U.S. Cl.
CPC ..... *F21V 19/003* (2013.01); *F21V 7/00* (2013.01); *F21V 29/70* (2015.01); *F21Y 2115/10* (2016.08)

(58) Field of Classification Search
CPC ..... F21K 9/00–90; F21V 3/06–0625; F21V 7/00; F21V 19/00–06; F21V 23/00–06; F21V 29/70; F21Y 2115/10
See application file for complete search history.

(56) References Cited

U.S. PATENT DOCUMENTS 11,092,322 B2 * 8/2021 Zhou ..... F21V 23/04

* cited by examiner

*Primary Examiner* — Jason M Han
(74) *Attorney, Agent, or Firm* — James A. Gavney, Jr.; JAG Patent Service.

(57) ABSTRACT

An LED lightbulb is disclosed. The LED lightbulb includes at least two sets of LEDs that emit two different color temperature light and that are located on a metal core printed circuit board. The combine intensity outputs of the at least sets of LEDs generate a selected corrected color temperature output. The corrected color temperature output is changed by rotating a diffusing unit with a conductive contact pad that engages contact tracks on color corrected temperature (CCT) buttons and thereby closing a circuit corresponding to a selected corrected color temperature output.

17 Claims, 6 Drawing Sheets

LED LIGHTBULB WITH ADJUSTABLE COLOR TEMPERATURE

FIELD OF THE INVENTION

This invention relates to light emitting diode lighting. More particularly, the present invention relates to a light emitting diode lightbulb with adjustable color temperature tuning.

BACKGROUND OF THE INVENTION

A light-emitting diode (LED) is a two-lead semiconductor light source. It is a pn-junction diode, which emits light when activated. When a suitable voltage is applied to the leads, electrons are able to recombine with electron holes within the device, releasing energy in the form of photons. This effect is called electroluminescence, and the color of the light (corresponding to the energy of the photon) is determined by the energy band gap of the semiconductor.

Recent developments in LEDs permit them to be used in environmental and task lighting. LEDs have many advantages over incandescent light sources including lower energy consumption, longer lifetime, improved physical robustness, smaller size, and faster switching. Light-emitting diodes are now used in applications as diverse as aviation lighting, automotive headlamps, advertising, general lighting, traffic signals, and camera flashes. However, LEDs powerful enough for room lighting are still relatively expensive, and require more precise current and heat management than compact fluorescent lamp sources of comparable output.

There are a number of LED lighting system that allow for adjustable color temperature tuning. This is typically accomplished by each of LED light fixtures within the LED lighting system having different sets of LEDs that emit different output spectra that include a component of white light. In operation light emitted from two different sets of LED combine to produce a combined output light intensity and combined output light color temperature. By adjusting the relative intensities of light output from the different sets of LEDs within the light fixtures, the light fixtures are capable of being adjusted to produce selected or target combined output light intensities and, therefor, selected or target combined output light color temperatures. Preferably, each of the LED light fixtures include a set of LEDs that emit a component of yellow light as well as a component of white light (warm white light) and a different set of LEDs that emit a component of blue light as well as well as a component of white light (cool white light).

SUMMARY OF THE INVENTION

Where the LED color temperature of each of the light fixtures within the system are color tuned at the light engine, such as at a LED lightbulb, there is typically a slide switch that is positioned on a side portion of a lighting housing of the LED lightbulbs. In operation the slide switch is manually adjusted to change the color temperature of the light emitted from the LED lightbulb. Where such color tunable LED lightbulbs are used in track-light fixtures and/or canister-type light fixtures, the LED lightbulbs need to be removed from the fixture to change the color temperature of light emitted, because the color temperature slide switch is not accessible with the LED lightbulb installed into the fixture. After the color temperature of light emitted by a LED lightbulb is changed, the LED lightbulb then needs to be reinstalled into the fixture.

To address the aforementioned shortcoming, the present invention is directed to a LED lightbulb that includes an adjustable color temperature mechanism that is accessible while the LED lightbulb is installed within a track-light fixture and/or a canister-type light fixture. The LED lightbulb includes a metal core printed circuit board (MCPCB) with at least two different types of LED arrays or LED tracks embedded therein. The at least two different types of LED arrays or LED tracks include for example LEDs that emit light color corresponding to approximately 2700 Kelvin and LEDs that emit light color corresponding to approximately 5000 Kelvin. The MCPCB also includes multiple color corrected temperature (CCT) buttons that form a CCT switch. Preferably, the MCPCB has 3 to 5 CCT buttons thereon. Each of the CCT buttons are in electrical communication with an internal LED driver unit and the LED arrays or LED tracks on the MCPCB through the appropriate circuitry and contacts, such that actuation of one of CCT buttons controls the combined intensity outputs of the at least two different LED arrays or LED tracks on the MCPCB to emit a selected total corrected light color temperature light.

The adjustable corrected color temperature mechanism includes, for example, a light diffusion unit formed from a reflector and a lens. The light diffusion unit includes an actuator structure that engages the different CCT buttons on the MCPCB depending on a rotational position of the light diffusion unit. By rotating the light diffusion unit different CCT buttons are actuated and a circuit pathway corresponding to a selected corrected color temperature is closed. With the appropriate circuit pathway closed relative output light intensities of the different LED arrays or LED tracks are adjusted to output the selected corrected color temperature light.

The CCT buttons described above can be buttons that are depressed moved or otherwise engaged by the light diffusing unit to change the corrected color temperature of the light emitted from the LED lightbulb. In a preferred embodiment of the invention the CCT buttons are raised structures with conductive tracks that are separated by a contact gap. The light diffusing unit includes a conducive pad or conductive ball on an inside surface. The conductive pad or conductive ball is made from a conductive material, such as copper. When the light diffusing unit is rotated to a selected position, one of the selected CCT circuits are closed through conductive tracks on the raised structures and the conductive pad or conductive ball that bridges the contact gap between the conductive tracks and, thereby, allowing the LED lightbulb to operate at the corresponding selected corrected color temperature output.

The LED lightbulb of the present invention allows the corrected color temperature output of the LED lightbulb to be adjusted or selected by rotating the light diffusing unit while the LED lightbulb remains installed (plugged into or screwed within a housing structure) of a track-light fixture or a canister-type light fixture.

DETAILED DESCRIPTION OF THE INVENTION

Figure 1A:
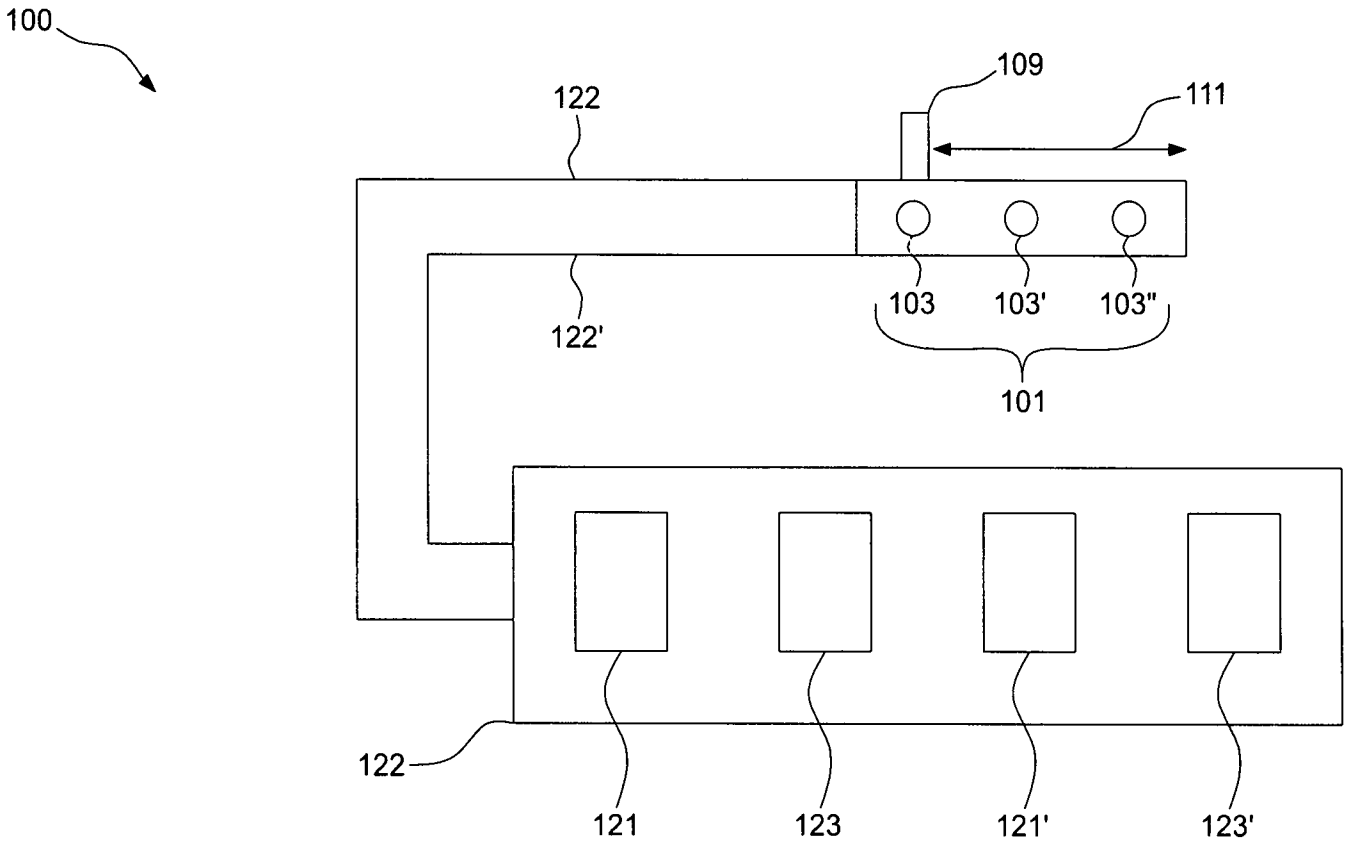
FIG. 1A shows a schematic representation of a corrected color temperature switch mechanism coupled to a metal core printed circuit board with two different sets LEDs.

The present invention is directed to a LED lightbulb. The LED light bulb includes a switch mechanism 100 to change or adjust LED arrays or LED tracks 121/121' and 123 and 123' to operate at a selected corrected color temperature outputs. The LED arrays or LED tracks 121/121' and 123 and 123' are on a metal core printed circuit board 122 and are in electrical communication with an LED driver 101 through electrical contacts 122 and 122'. The switch mechanism 100 includes a toggle 109 that moves, as indicated by the arrow 111, to different contact locations 103, 103', and 103" and cause the LED driver 101 to power the LED arrays or LED tracks 121/121' and 123 and 123' at different relative intensity levels to generate the different corrected color temperature outputs.

Figure 1B:
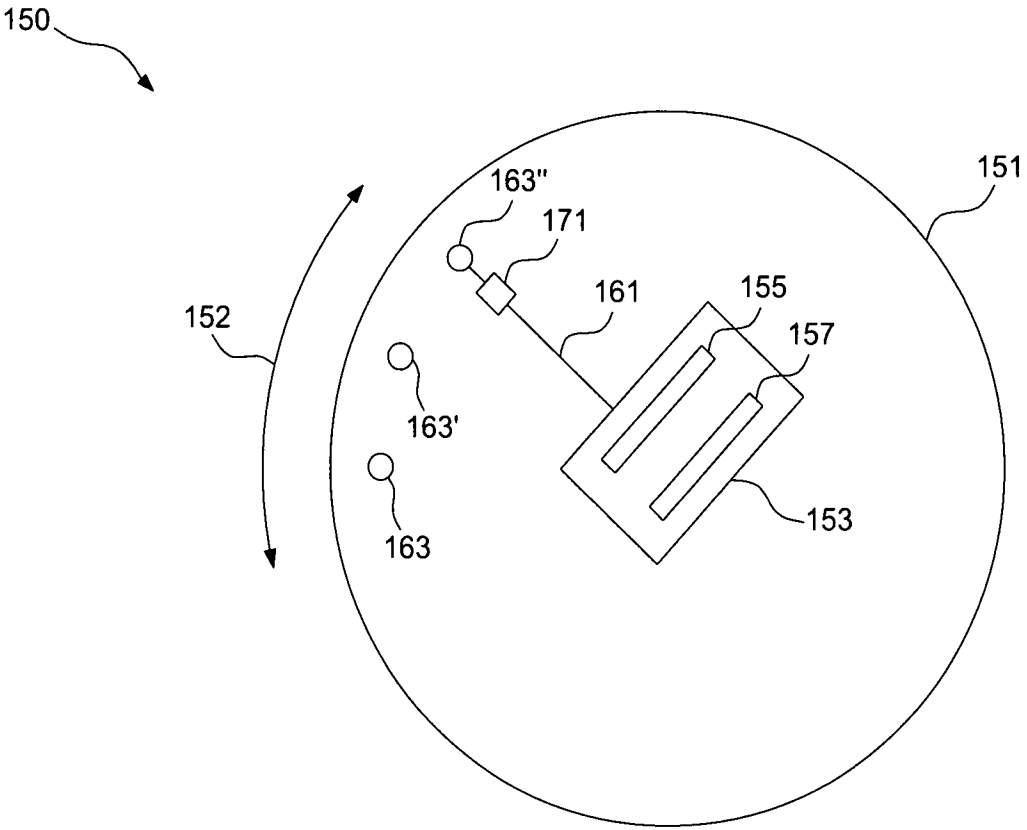
FIG. 1B shows a schematic representation of a rotating corrected color temperature switch coupled to a metal core printed circuit board with LED arrays or LED tracks that each emit a different color temperature of light, in accordance with the embodiments of the invention.

Referring now to FIG. 1B, a switch mechanism 150 preferably includes a light diffusing unit 151. The light diffusing unit 151 is preferably formed from a lens and a reflector, such as described below. In operation, the diffusing unit 151 is rotated, as indicated by the arrow 152, to move a contact switch 171 to different locations 163, 163' and 163" and operate or change the relative output intensities of LED arrays or LED tracks 155 and 157 located on a metal core printed circuit board 153. The LED arrays or LED tracks 155 and 157 are in electrical communication with an LED driver (not shown) and have LEDs that emit light with different color temperature outputs.

Figure 1C:
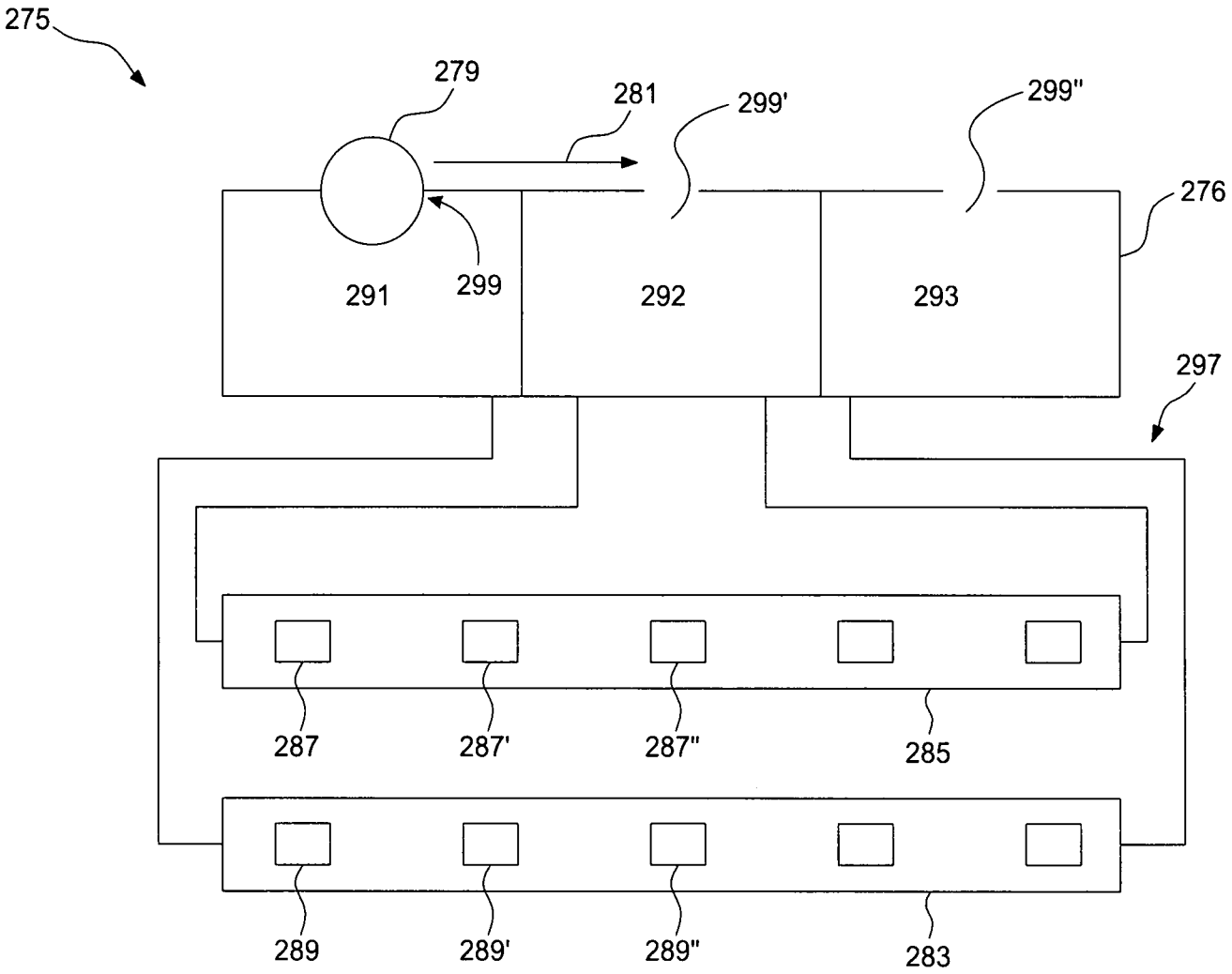
FIG. 1C shows a schematic representation of a corrected color temperature switch mechanism that includes conductive tracks that are separated by contact gaps that are and closed by a movable conductive pad or conductive ball to actuate the LED arrays or LED tracks to operate at a selected corrected color temperature output, in accordance with the embodiments of the invention.

FIG. 1C shows a schematic view of a LED light circuit 275 with a corrected color switch mechanism 276 to change or adjust LED arrays or LED tracks 121/121' and 123 and 123' to operate at a selected corrected color temperature outputs resulting from the combined intensity outputs from the different color temperature LEDs 287/287'/297" and 289/289'/289", respective, on the printed circuit boards 285 and 283, respectively. The corrected color switch mechanism 275 includes a conductive contact pad or conductive contact ball 279 that is capable of being moved as indicted by the arrow 281. The conductive contact pad or conductive contact ball 279 is capable of being moved by, for example, through rotatable diffusing unit 151 (FIG. 2B). When the contact pad or contact ball 279 is placed over the contact bridge or contact gap 299, 299' and 299", respectively, circuits 291, 292 and 293 are closed and a LED driver circuit controls the relative intensity outputs of the two different color temperature sets of LEDs 287/287'/297" and 289/289'/289". The combined intensity outputs of the two different color temperature sets of LEDs 287/287'/297" and 289/289'/289", thereby, generate a selected corrected color temperature output. It will be clear to one stilled in the art that the LED lightbulb of the present invention includes all of the necessary electrical connections and circuitry, including a LED driver circuit, between the corrected color temperature switch mechanism 276 and the sets of LEDs 287/287'/297" and 289/289'/289" to perform the described corrected color temperature tuning function.

Figure 2A:
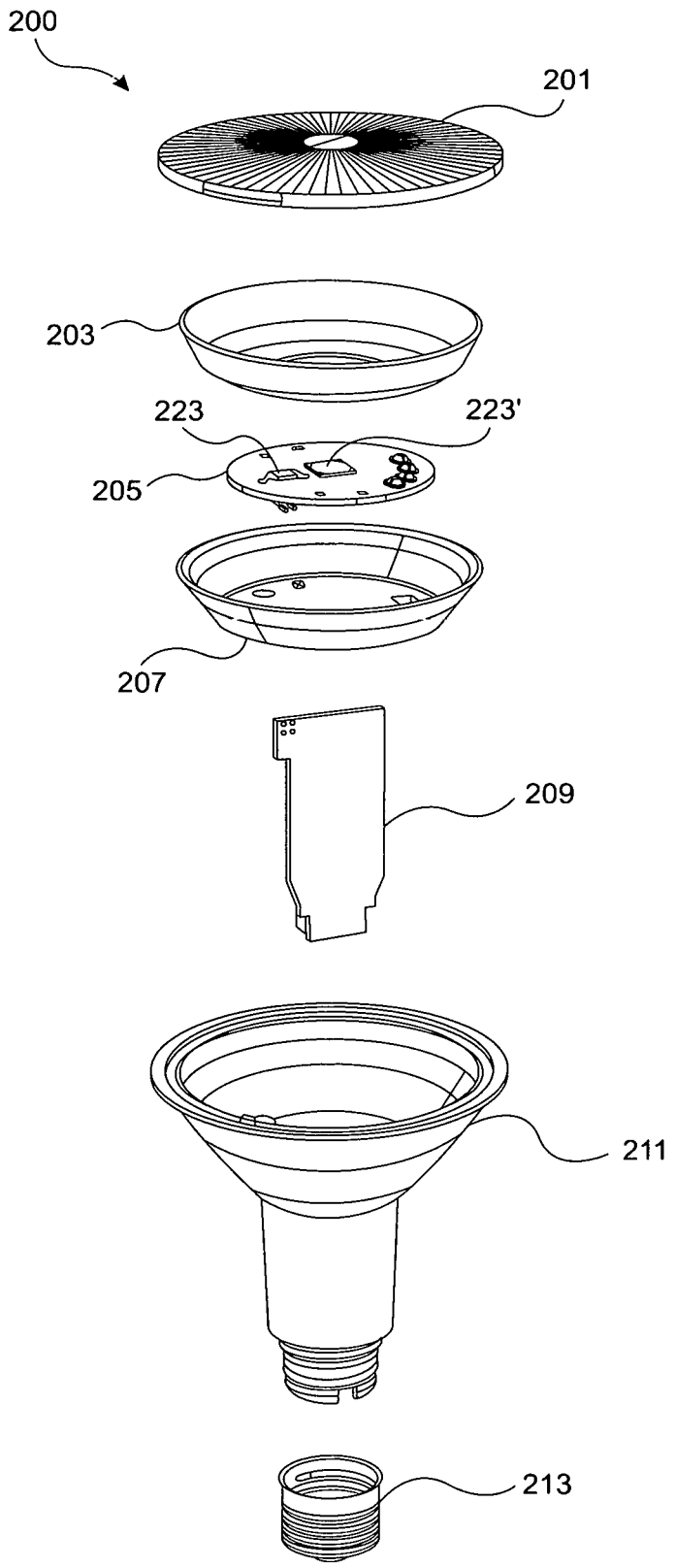
FIG. 2A shows an exploded view of a LED lightbulb that includes an adjustable corrected color temperature mechanism that is accessible while the LED lightbulb is installed within a track-light fixture and or canister-type light fixture, in accordance with the embodiments of the invention.
Figure 2B:
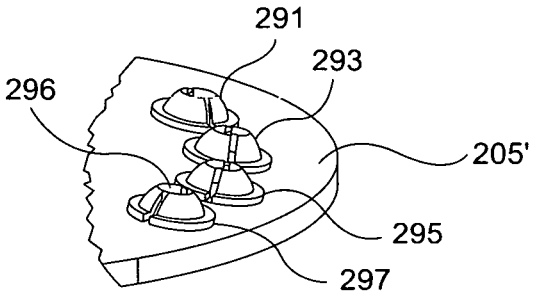
FIGS. 2B-D show detailed views of the rotating corrected color temperature switch mechanism used to change or adjust LED arrays or LED tracks to operate at a selected corrected color temperature outputs, in accordance with the embodiments of the invention.

FIG. 2A shows an exploded view 200 of an LED lightbulb with a rotatable corrected color temperature tuning switch mechanism, in accordance with the embodiments of the present invention. The LED light bulb includes a lens 210, a reflector 203, a metal core printed circuit board 205 with two different types of LED arrays or LED tracks 223 and 233', an integrated heat sink 207, an integrated LED driver 209, a housing and a conductive socket cap 213 that is in electrical communication with the LED driver circuit. While the connection to an external power is shown here as a threaded conductive socket cap 213, it will be clear to one skilled in the art that the LED lightbulb of the present invention can be connected to an eternal power source through other means including, but not limited to, conductive contact pins and conductive contact strips.

Figure 2C:
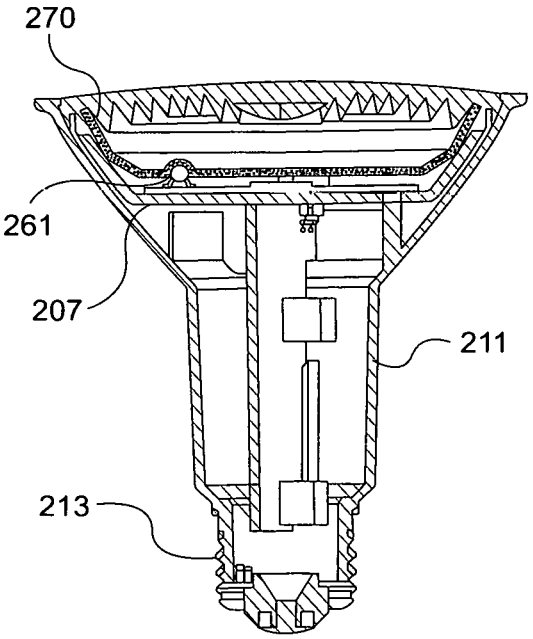
Figure 2D:
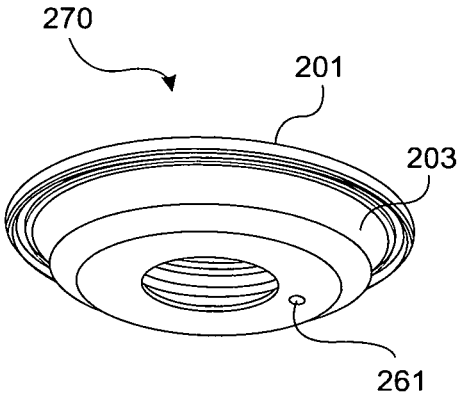
Figure 2D:
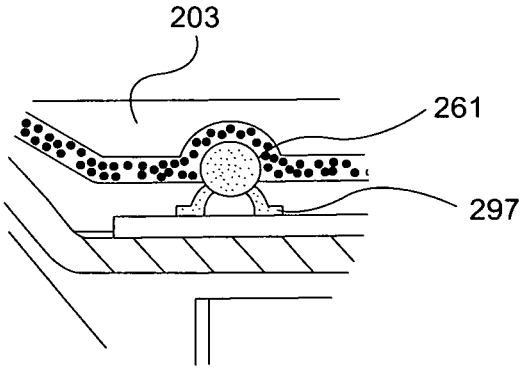
Figure 3:
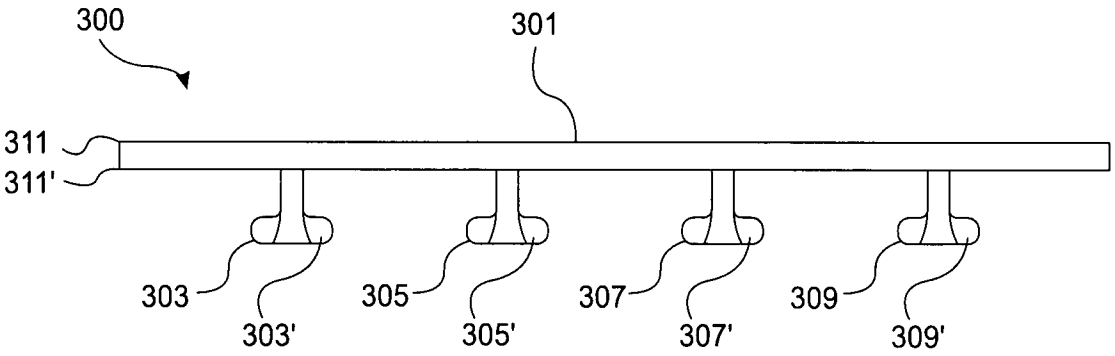
FIG. 3 shows a schematic view of a track-light fixture with multiple LED lightbulbs each with a corrected color temperature switch mechanism to individually change or adjust LED arrays or LED tracks to operate at selected corrected color temperature outputs, in accordance with the embodiments of the invention.

FIGS. 2B-D show detailed views of the a rotatable corrected color temperature tuning switch mechanism used to change or adjust LED arrays or LED tracks to operate at a selected corrected color temperature output, in accordance with the embodiments of the invention. As described above the LED lightbulb includes a rotatable diffusing unit 270 that is formed from a lens 201 and a reflector 203. On a bottom surface of the reflector 203, there is a conductive contact pad or conductive contact ball 261. The conductive contact pad or conductive contact ball 261 is formed from any suitable conductive material such as copper. On a top surface of a portion 205' of the metal core printed circuit board 205, there are color corrected temperature (CCT) buttons 291, 293, 295 and 297 that have conductive tracks separated by contact bridges or contact gaps 296. As shown in FIG. 2D, when the conductive contact pad or conductive contacts ball 261 is placed over the contact bridge or contact gap and between the conductive tracks of the color corrected temperature (CCT) button 297, a circuit is closed that correspond to a selected corrected color temperature output from the combined outputs of the two different LED arrays or LED tracks 223 and 223' on the metal core printed circuit board 205. In a preferred embodiments of the invention one of the LED arrays or LED tracks 223 has an output light color temperature corresponding to approximately 2,700 Kelvin and the other of the LED arrays or LED tracks 223" has an output light color temperature corresponding to approximately 5,000 Kelvin.

By rotating the diffusing unit 270 to a position where the conductive contact pad or conductive contact ball 261 engages one of the remaining color corrected temperature (CCT) buttons 291, 293 and 295, such as described above, a correspond circuit is closed and, thereby, changing the selected corrected color temperature output emitted through the lens 201 from the two different LED arrays or LED tracks 223 and 233'

The LED lightbulb of the present invention is preferably used in a track-light fixture 300. The track-light fixture 300 includes a power strip 301 with electrical connections 311 and 311' for coupling to an external power source. The track-light fixture also includes a number of canister or housing structures 303, 305 307 and 309 that can be repositioned within or along the power strip 301. Within each of the canister or housing structures 303, 305 307 and 309 there is a corresponding LED lightbulb 303', 305', 307' and 309' with corrected color temperature tuning, such as the LED lightbulb described above with reference to FIGS. 2A-B. The LED lightbulbs 303', 305', 307' and 309' can each be adjusted to change the color temperature output by, for example, rotating a diffusing unit through a lens (201; FIG. 2A), such as the diffusing unit 270 (FIG. 2D), while the LED lightbulbs 303', 305', 307' and 309' remain installed within the canister or housing structures 303, 305 307 and 309 of the track-light fixture 300. Preferably the lens 201 is a Fresnel lens and is patterned, has contours and/or protrusions that allow a user to readily rotate the diffusing unit 270 to change the selected corrected color temperature output from the each of the LED lightbulbs 303', 305', 307' and 309'.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A LED lightbulb comprising a corrected color temperature tuning switch mechanism that includes a rotatable light diffusing unit with a conductive contact that engages contacts of different color corrected temperature (CCT) buttons when rotated to, thereby, actuate LED arrays or LED tracks to emit light at selected corrected color temperatures outputs.

2. The LED lightbulb of claim 1, wherein the LED arrays or LED tracks includes LEDs that emit light corresponding to 2,700 Kelvin and 5,000 Kelvin.

3. The LED lightbulb of claim 1, wherein the light diffusing unit includes a lens and a reflector.

4. The LED lightbulb of claim 3, wherein the LED arrays or LED tracks are on a metal core printed circuit board positioned below the reflector and the lens.

5. The LED lightbulb of claim 4, further comprising an integrated heat sink coupled to the metal core printed circuit board.

6. The LED lightbulb of claim 1, color corrected temperature (CCT) buttons include conductive tracks that are separated by a contact bridge or contact gap, and wherein the conductive contact closes a circuit corresponding to a selected color temperature by contacting the conductive tracks.

7. The LED lightbulb of claim 1, wherein the conductive contact is a metal ball.

8. An LED lightbulb a) a lens:

b) a rotatable reflector with a conductive contact and coupled to the lens;

c) a printed circuit board positioned below the reflector and the lens having two different LED arrays or LED tracks that emit light having different color temperatures through the lens;

d) an integrated heat sink coupled to the metal core printed circuit board;

e) an integrated LED driver electrically coupled to the two different LED arrays or LED tracks on the metal core printed circuit board;

f) a housing with a conductive socket cap that is in electrical communication with the integrated LED driver; and g) a rotatable corrected color temperature tuning switch mechanism connecting to the rotatable reflector for selecting different corrected color temperature light that is emitted by the LED arrays or LED tracks through the lens.

9. The LED lightbulb of claim 8, where in the rotatable corrected color temperature tuning switch mechanism includes the conductive contact that engages different color corrected temperature (CCT) buttons when rotated.

10. The LED lightbulb of claim 8, wherein the LED arrays or LED tracks includes LEDs that emit light corresponding to 2,700 Kelvin and 5,000 Kelvin.

11. The LED lightbulb of claim 9, wherein the color corrected temperature (CCT) buttons include conductive contact tracks that are separated by a contact bridge or contact gap, and wherein the conductive contact closes a circuit corresponding to a selected corrected color temperature.

12. The LED lightbulb of claim 11, wherein the conductive contact is a metal ball.

13. A LED lightbulb a) a light diffusing unit:

b) a metal core printed circuit board covered by the light diffusing unit and having two different LED arrays or LED tracks that emit light having different color temperatures through the lens;

c) an integrated heat sink coupled to the metal core printed circuit board;

d) an integrated LED driver electrically coupled to the two different LED arrays or LED tracks on the metal core printed circuit board; and e) a corrected color temperature tuning switch mechanism including the light diffusing unit with a conducive contact that engages contacts of different color corrected temperature (CCT) buttons when the light diffusing unit is rotated to actuate LED arrays or LED tracks to operate selected corrected color temperatures.

14. The LED lightbulb of claim 13, wherein the conducive contact is rotated through the diffusing unit formed from a lens and a reflector.

15. The LED lightbulb of claim 13, wherein the LED arrays or LED tracks includes LEDs that emit light corresponding to 2,700 Kelvin and 5,000 Kelvin.

16. The LED lightbulb of claim 13, wherein the color corrected temperature (CCT) buttons include conductive tracks that are separated by a contact bridge or contact gap, and wherein the conductive contact closes a circuit corresponding to a selected corrected color temperature.

17. The LED lightbulb of claim 16, wherein the conductive contact is a metal ball coupled to a surface of the light diffusing unit.

* * * * *